US007047770B2

(12) United States Patent
Broker et al.

(10) Patent No.: US 7,047,770 B2
(45) Date of Patent: May 23, 2006

(54) WASHING MACHINE AGITATION ACTION CONTROL

(75) Inventors: John F. Broker, Colfax, IA (US); Jordan S. Bruntz, Baxter, IA (US); Donald E. Erickson, Newton, IA (US); Scott E. Griffith, Newton, IA (US); Douglas A. Ochsner, Newton, IA (US); Gary T. Ostrander, Newton, IA (US); Evan R. Vande Haar, Pella, IA (US)

(73) Assignee: Maytag Corporation, Newton, IA (US)

( * ) Notice: Subject to any disclaimer, the term of this patent is extended or adjusted under 35 U.S.C. 154(b) by 489 days.

(21) Appl. No.: 10/205,256

(22) Filed: Jul. 23, 2002

(65) Prior Publication Data

US 2004/0016061 A1 Jan. 29, 2004

(51) Int. Cl.
*D06F 33/02* (2006.01)
*H07P 5/46* (2006.01)

(52) U.S. Cl. ..... 68/12.16; 68/12.17; 68/133; 318/66; 318/779

(58) Field of Classification Search ..... 68/12.16, 68/12.17, 23.7, 131–134; 318/66, 778, 779, 318/811, 254
See application file for complete search history.

(56) References Cited

U.S. PATENT DOCUMENTS 3,474,646 A 10/1969 Sims et al.
3,589,148 A 6/1971 Wasemann
4,215,303 A 7/1980 Brimer
4,513,230 A 4/1985 Erdman
4,835,991 A 6/1989 Knoop et al.
4,857,814 A * 8/1989 Duncan ..... 318/281
4,950,969 A 8/1990 Getz
4,972,134 A 11/1990 Getz et al.
5,074,003 A 12/1991 Manson et al.
5,271,116 A 12/1993 Williams et al.
5,333,474 A 8/1994 Imai et al.
5,341,452 A * 8/1994 Ensor ..... 318/811
5,398,298 A * 3/1995 Ensor ..... 318/811
5,515,565 A 5/1996 Maddix et al.
6,025,682 A 2/2000 Bruntz et al.
RE37,360 E * 9/2001 Duncan ..... 318/281
2003/0208852 A1* 11/2003 Hardaway et al. ..... 8/158
2004/0060123 A1* 4/2004 Lueckenbach et al. ..... 8/159

* cited by examiner

*Primary Examiner*—Joseph L. Perrin
(74) *Attorney, Agent, or Firm*—McKee, Voorhees & Sease, P.L.C.

(57) ABSTRACT

An apparatus, method and system of wash action control for an automatic washing machine. A manually operable user interface allows selection from between a plurality of discrete agitation speed selections which comprise at least a continuous speed agitation mode for a given agitation period during a wash cycle and an intermittent speed agitation mode for at least a part of a given agitation period. The intermittent speed agitation mode automatically varies agitation speed between at least two sub-periods of the given agitation period. The variation in agitation speed can be between a faster and a slower speed or a certain speed and no agitation.

24 Claims, 11 Drawing Sheets

A
B
C
D
E
F
G
H
I
J
K
L
M
N
O
P
Q
W-C H-C
C-C W-C
W-C C-C
64
4
B
T
66
3
T
B
TEMP
CONT.
SWITCH
(OFF)
(45)
TEMP
CONTROL
TEMP
CONTROL
LIGHT
16
14
TIMER
MOTOR
(56)
WATER
VALVE
COLD
HOT
CHIME SWITCH
22
(OFF)
HI
LO
CHIME
X-RINSE (OFF)
FULL
EMPTY
WATER LEVEL
SWITCH
(47)

WASHING MACHINE AGITATION ACTION CONTROL

INCORPORATION BY REFERENCE

U.S. Pat. No. 6,025,682 is incorporated by reference herein in its entirety.

I. BACKGROUND OF THE INVENTION

A. Field of the Invention

The present invention relates to agitation control for a washing machine, and in particular, to user-selectable agitation action and speed.

B. Problems in the Art

Modern washing machines usually employ a number of functional features. This includes a variety of washing regimes (e.g. regular, permanent press, soak only). Most machines include user-selectable controls allowing the user to set the machine differently for different washing tasks, action, or regimes. For example, selection of a "regular" washing regime usually indicates a longer wash cycle, and relatively substantial wash action (e.g. faster agitation and spin speeds). Another example is a delicate or permanent press regime, which usually indicates shorter wash cycle and less wash action (e.g. slower agitation).

It has been found to be desirable to have different agitation robustness for different washing tasks. By selection between pre-programmed wash regimes or cycles, the user has some control over the gentleness or robustness of mechanical wash action. The user usually selects the type of washing regime, and the machine automatically follows a pre-programmed wash action for that regime. The user normally does not have control over washing action other than washing regime selection.

One way different washing or agitation action is created in an automatic washing machine is by utilizing a multi-speed electric motor that can rotate or reciprocate an agitation impeller (also sometimes referred to as the agitator) at different speeds. One specific example is U.S. Pat. No. 3,474,646. The user operates a control knob to select between three discrete agitation speeds from a three speed (high, medium, and low speed) motor, regardless of which washing cycle or regime is selected from a separate control. While this provides three agitation speed choices for the user, independent of washing cycle, it is generally the case that the more speeds of a motor, the higher the cost and complexity.

Another approach is to vary what might be called the "duty cycle" of agitation. In other words, the machine allows the user to select cumulative agitation robustness over a standard period of time. This can be accomplished, e.g., by dividing the standard period of time into alternating sub-periods of different agitator impeller speeds or by lengthening or shortening cumulative duration of agitation. The amount of energy imparted to the clothes by the impeller during the period is a function of the average impeller speed during the period. One example of this is U.S. Pat. No. 3,589,148.

A still further solution was suggested by the owner of the present application. In an embodiment described in U.S. Pat. No. 6,025,682 ("the '682 patent"), the user is presented with four different agitation options. First is "continuous fast", meaning the faster speed of a two speed motor is continuously applied to the impeller during an agitation period. The second is "continuous slow", meaning the slower speed of the two-speed motor is continuously applied to the impeller during the agitation time. A third can be called "intermittent fast", and in the '682 patent comprises sub-periods of alternating fast and slow agitation speed of the impeller during an agitation period. During that period, the agitation speed, on average, would be considered intermediate between fast and slow; thus, not only a different type of agitation, but also a third "speed". The fourth is referred to as "intermittent slow", comprising alternating sub-periods of slow agitation and no agitation. On average, over the agitation period, this is both a different type of agitation and a fourth "speed"; slower than continuous slow.

Additionally, in the '682 patent, a user can adjust the agitation duty cycle in either intermittent fast or intermittent slow regimes. The user can infinitely variably adjust, within a range, duration of sub-periods of differing impeller speed. An example would be, in intermittent fast mode, lengthening sub-periods of fast agitation, which would shorten sub-periods of slow agitation; which would mean the average speed over the entire agitation period becomes closer to "continuous fast". Conversely, sub-periods of fast could be shortened, which would lengthen sub-periods of slow; resulting in an average speed over the entire period closer to "continuous slow". In other words, the user could select longer sub-periods of fast agitation and shorter periods of slow agitation in "intermittent fast" mode, or vise versa; and select longer sub-periods of slow agitation and shorter periods of no agitation, or vise versa, in the "intermittent slow" mode, over a range of values, giving a range of different "average" speeds between continuous fast or continuous slow respectively.

As is well known in the art, present washing machines generally are pre-programmed or pre-designed to follow a sequence of functions during any selected washing regime. The agitator is operated only at certain times of most regimes. As described, the '682 patent allows for user-selectability of speed and/or duty cycle of agitation at the times agitation occurs, including two settings with infinitely variable adjustability within the setting. Thus, with infinitely variable adjustability, in either intermittent fast or intermittent slow agitation speed selection, the user has an additional manually adjustable control that can alter agitation speed over a range of speeds within that general class of speed (i.e. intermittent fast or intermittent slow). For example, if intermittent fast is selected, which averages to a medium speed, the user can also infinitely variable adjust the speed between higher intermittent fast and slower intermittent fast.

Thus, using just a two-speed motor, the '682 patent provides four different agitation "speed" options from which the user can manually select. Thus, the user can in a sense "override" or dictate the robustness of the washing action, regardless of which washing regime or cycle is selected, by a selection from continuous fast, intermittent fast, continuous slow and intermittent slow agitation speeds from a manually operated control on the washing machine control panel.

The '682 patent accomplished this infinite variability by utilizing a variable resistor, manually controlled by the user from the control panel, as the mechanism for allowing infinitely variable selectivity of a duty cycle (how long or short the sub-periods of fast, slow or no agitation are) in the two intermittent modes. It also includes a microprocessor controlled timer circuit, which is used by the system to know where the washing machine is in any given regime of washing, and a microprocessor controlled two-relay switch to create the intermittent periods in the intermittent modes; i.e. switch the motor between fast and slow or slow and no agitation.

The '682 patent is one way to give the user more choices and expanded control of agitation. Although the solution of the '682 patent works well for its intended purpose, it is believed there may be room for improvement in this area because of a combination of factors. Although providing substantial user-control of and options for washing action and providing more than two agitation "speeds" from a two-speed motor, the microprocessor-controlled dual relays and timer circuit and the variable resistor add significant cost to the machine. The cost may not justify the amount of user-selectable options offered by the '682 patent solution.

Therefore, it is believed that there is room for improvement in the art for an alternative way to provide expanded user-controlled agitation in a more economical way.

It is therefore a principle object of the present invention to provide a beneficial method of agitation control. Other objects, features, or general advantages of the present invention can include:

1. increased options for wash action by economical means;
2. increased options for wash action without using microprocessor or electronic technology;
3. increased options for wash action utilizing an electromechanical timer circuit;
4. economy;
5. efficiency;
6. durability;
7. relatively non-complex structure and method;
8. ease of user selectability; and
9. flexibility and adaptability for different pre-designed wash action regimes.

These and other objects, features, and advantages of the present invention will become more apparent with reference to the accompanying drawings and claims.

II. BRIEF SUMMARY OF THE INVENTION

The present invention relates to a wash action control system for a washing machine having a wash tub or drum, an impeller or agitator within said wash tub, and a motor for operating the agitator. An electrical control circuit is connected to the motor, and includes an electrical timer motor which operates a timer for providing power to an agitation speed selection control, having a plurality of discrete speed selections, at least one of the selections enabling the control circuit, by electromechanical components, to cause the motor to operate the agitator at intermittent times during an agitation period. The agitation speed selection control can also cause the motor to operate the agitator continuously during an agitation period.

An optional aspect of the invention includes an electrical motor having a plurality of speeds for operating the agitator at a plurality of different speeds. The agitation speed selection control allows a user to select between agitation speed modes regardless of washing regime or cycle. These speed modes include, for example, a continuous speed over an agitation period instructed by the control circuit and electromechanical components based on a user-selected washing regime or cycle. Another example is an intermittent speed where the control circuit and electromechanical components operate to cause the motor to operate the agitator at one speed for at least one sub-period of an agitation period, and operate said agitator at either another speed or at no agitation for at least one different sub-period of the agitation period. The differing agitation speeds can be alternated for successive plural sub-periods.

III. BRIEF DESCRIPTION OF THE DRAWINGS

Figure 3A:
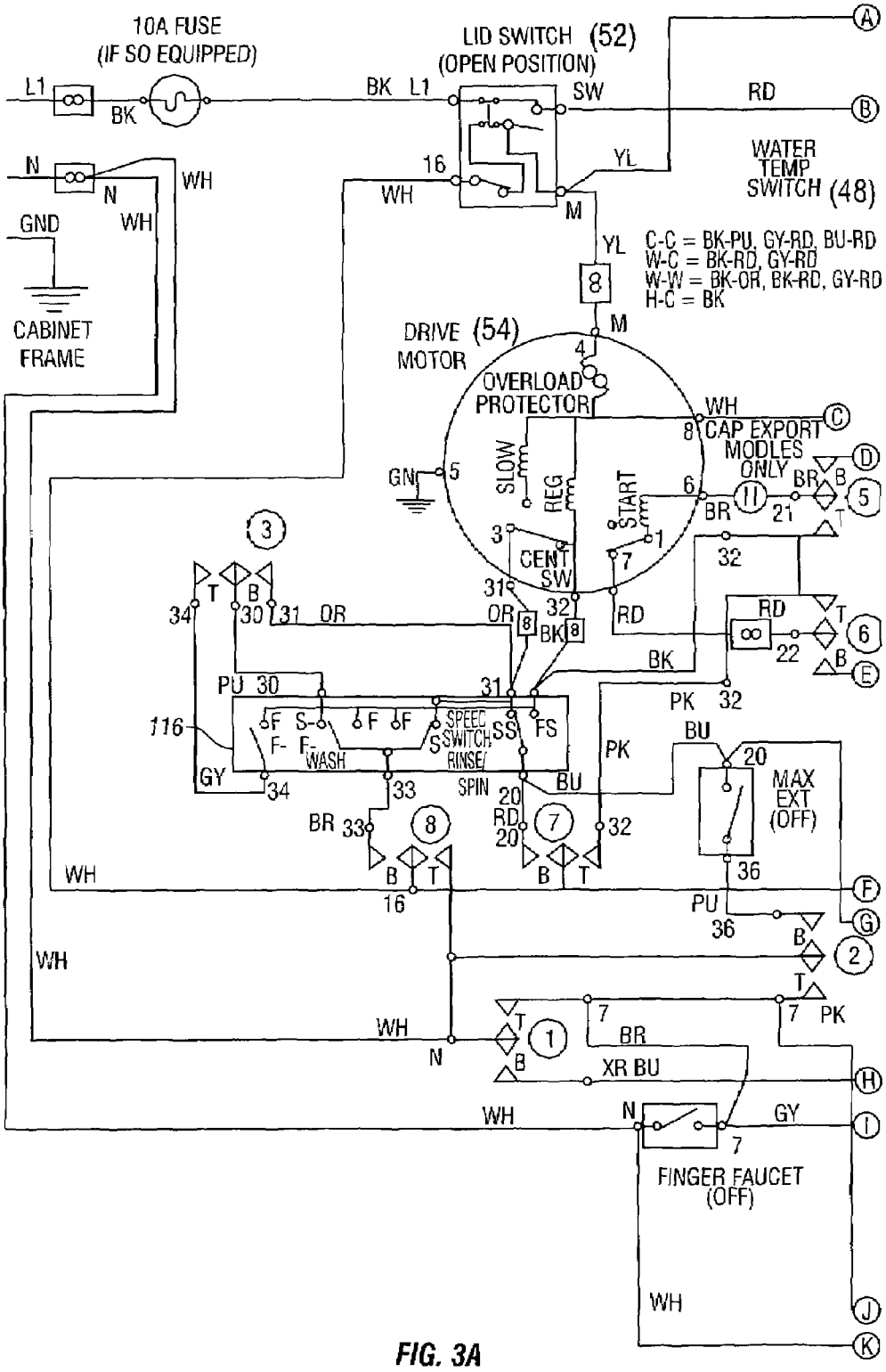
Figure 3B:
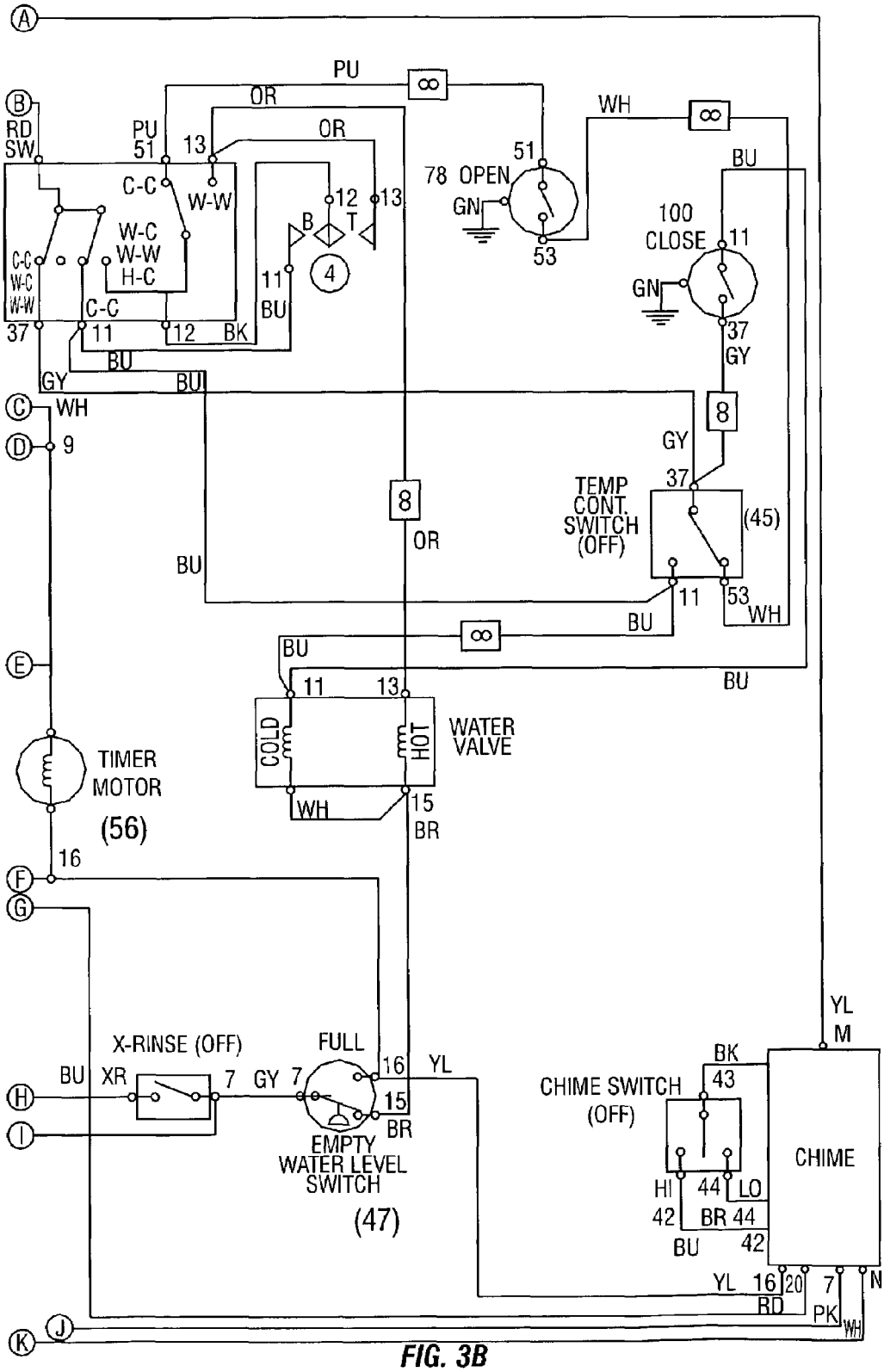

FIGS. 3A–B is an electrical circuit diagram for an exemplary embodiment of multiple speed control according to the present invention.

Figure 4A:
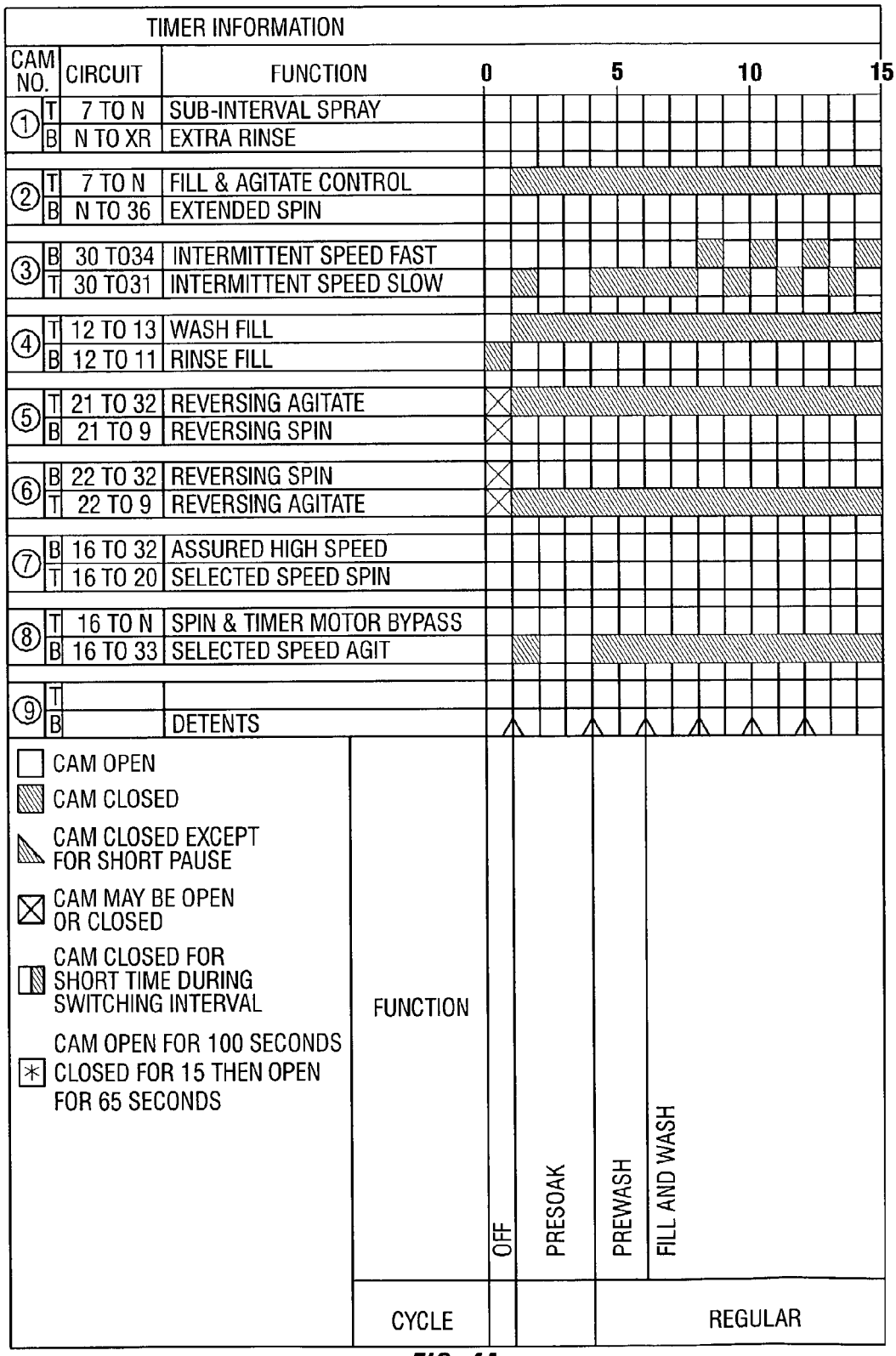
Figure 4B:
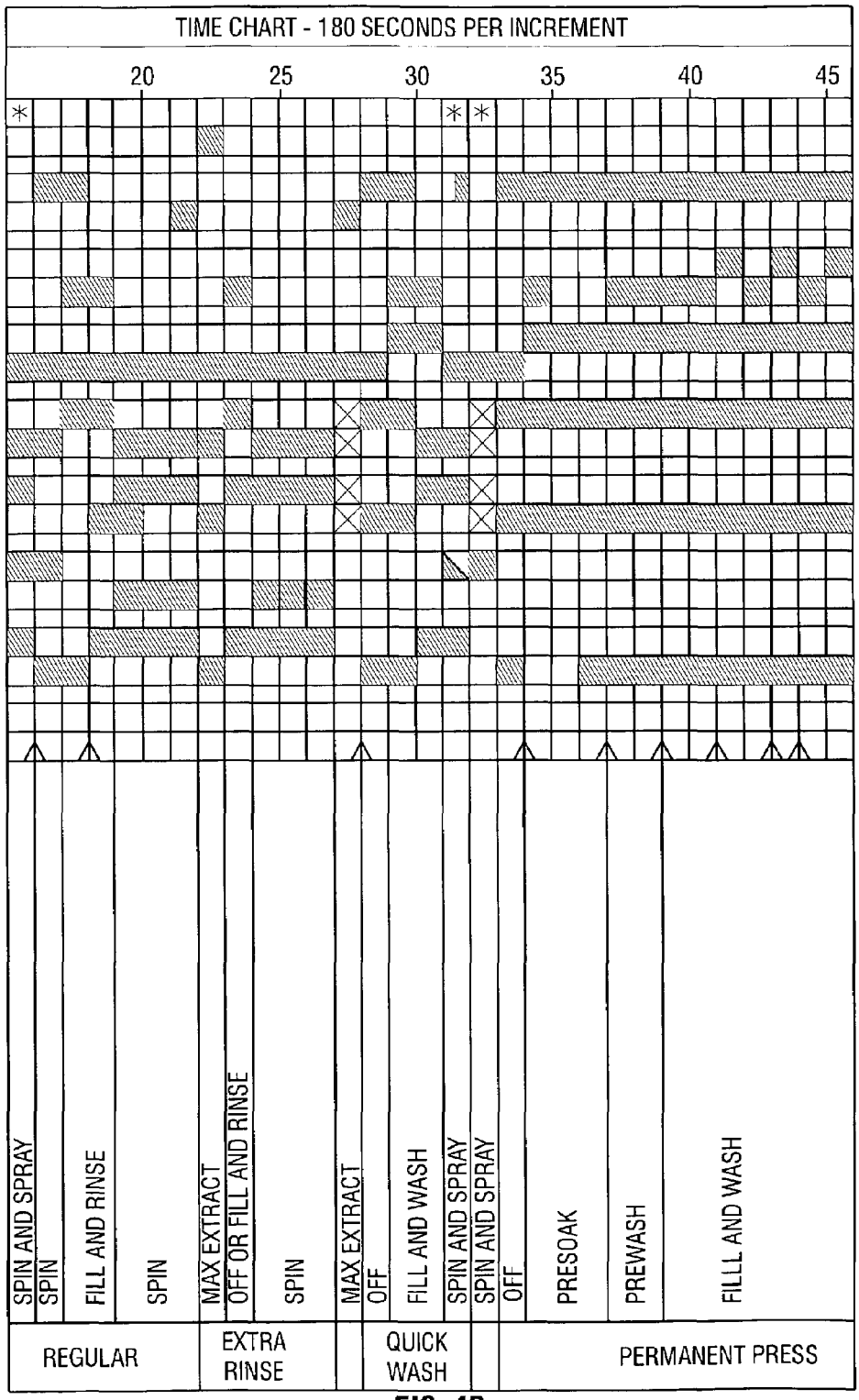
Figure 4C:
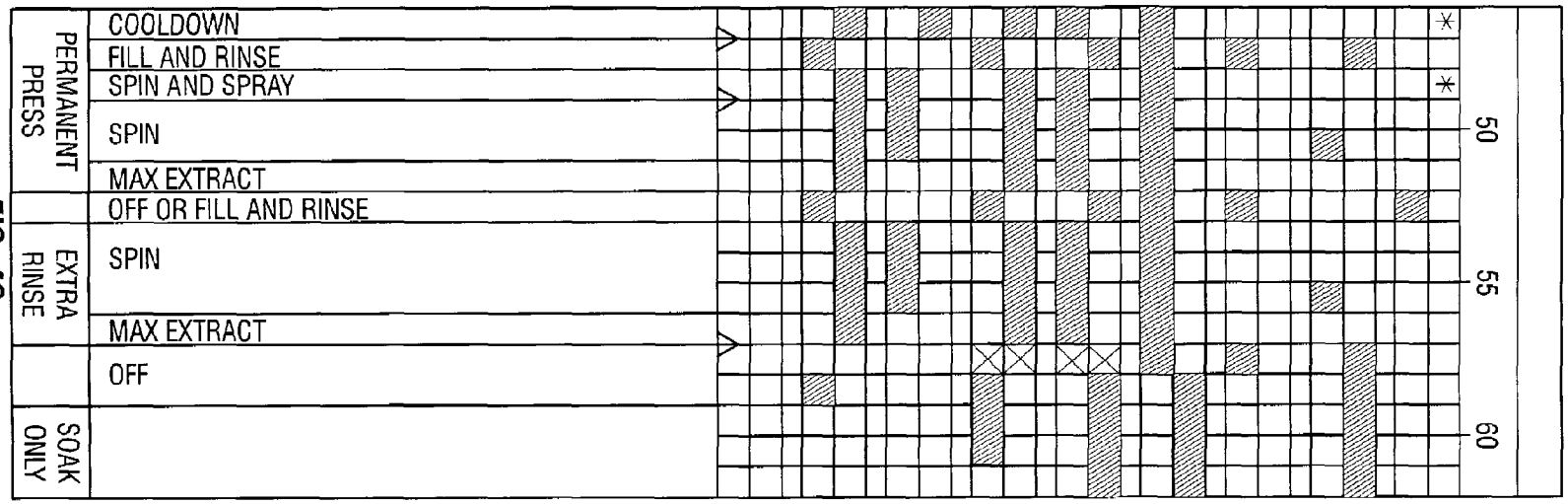

FIGS. 4A–C is a timing chart for the electrical circuit of FIG. 3.

Figure 5A:
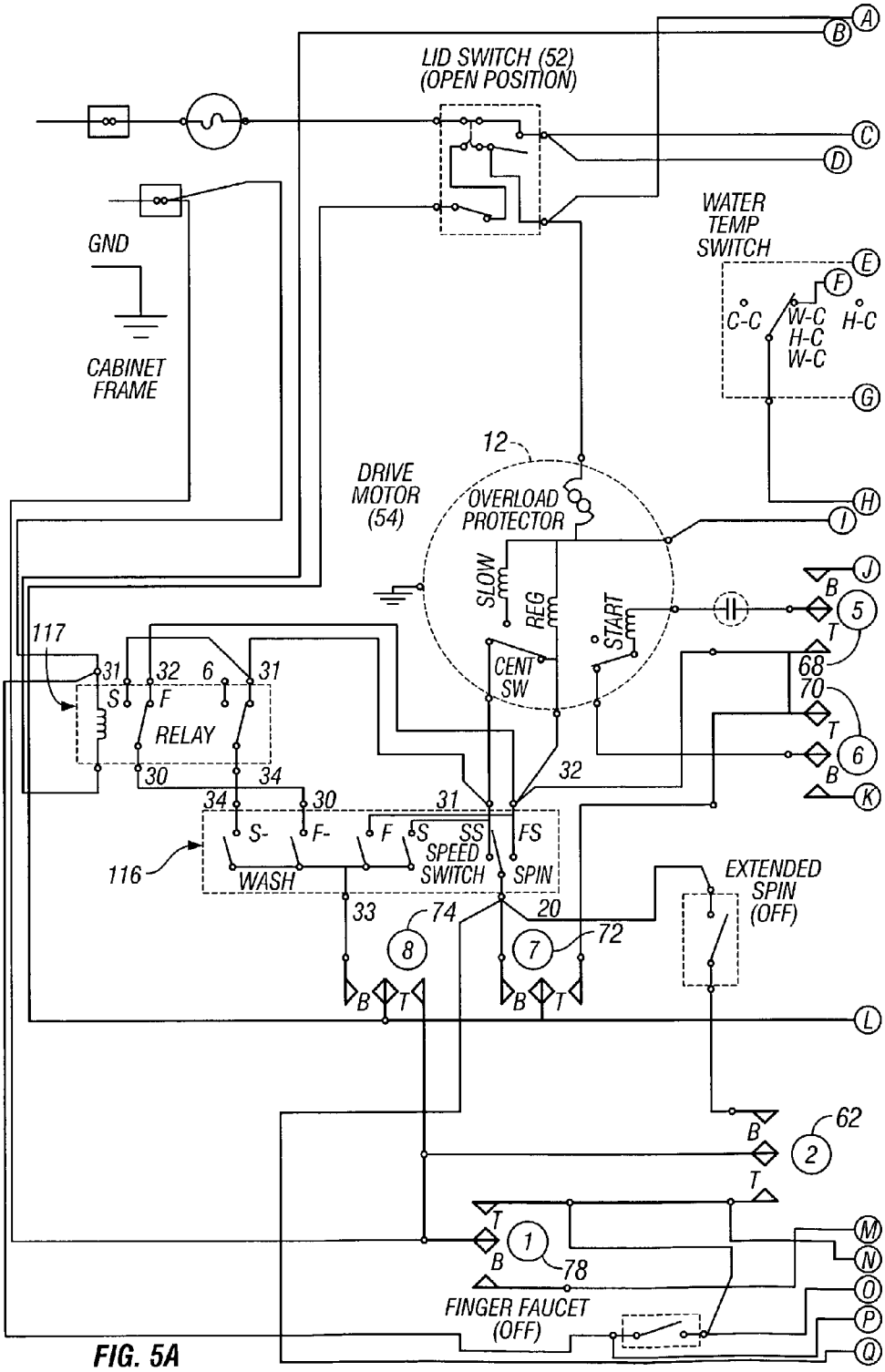
Figure 5B:
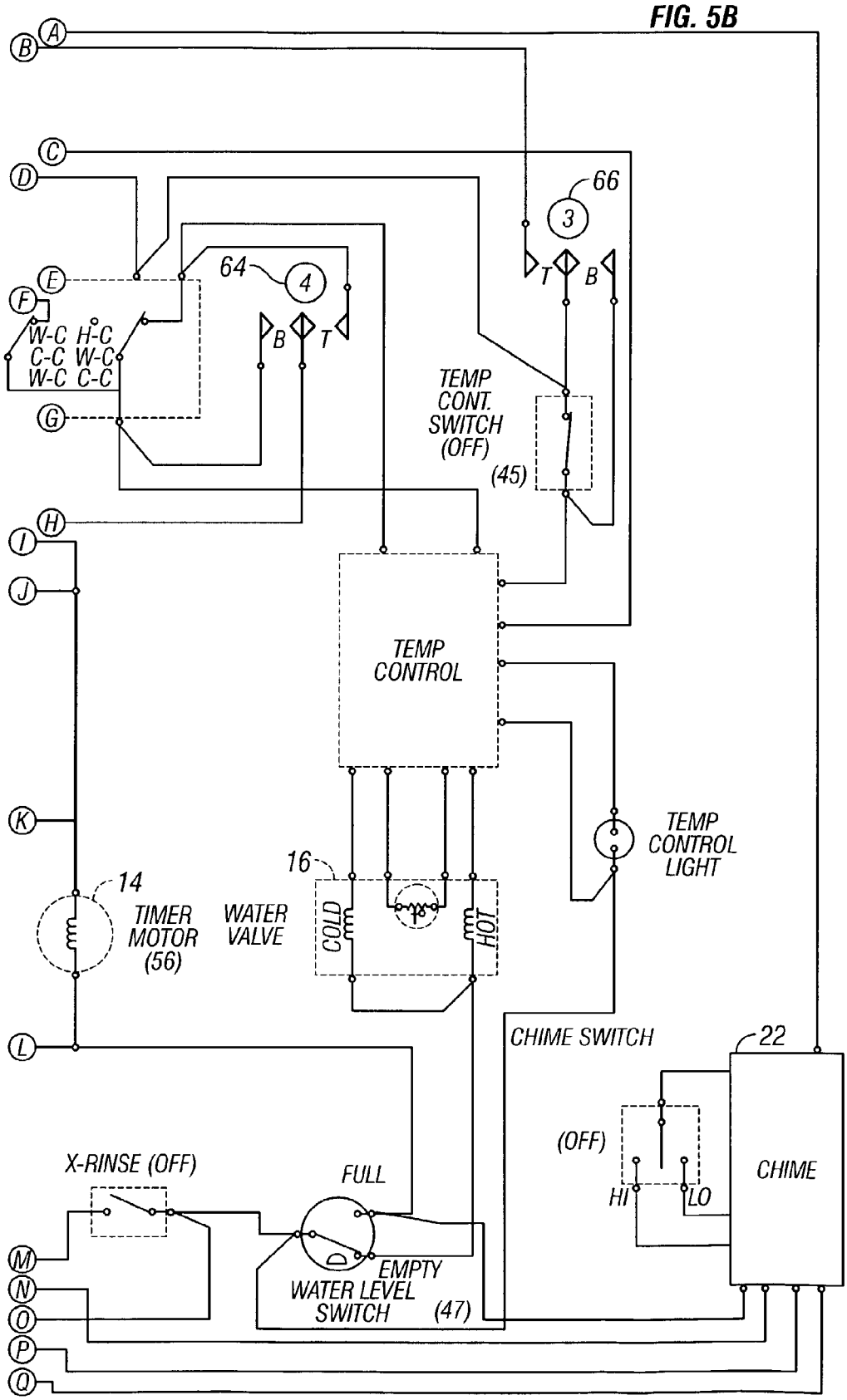

FIGS. 5A–B is an electrical circuit diagram of an alternative embodiment for a multiple speed control according to the present invention.

Figure 6A:
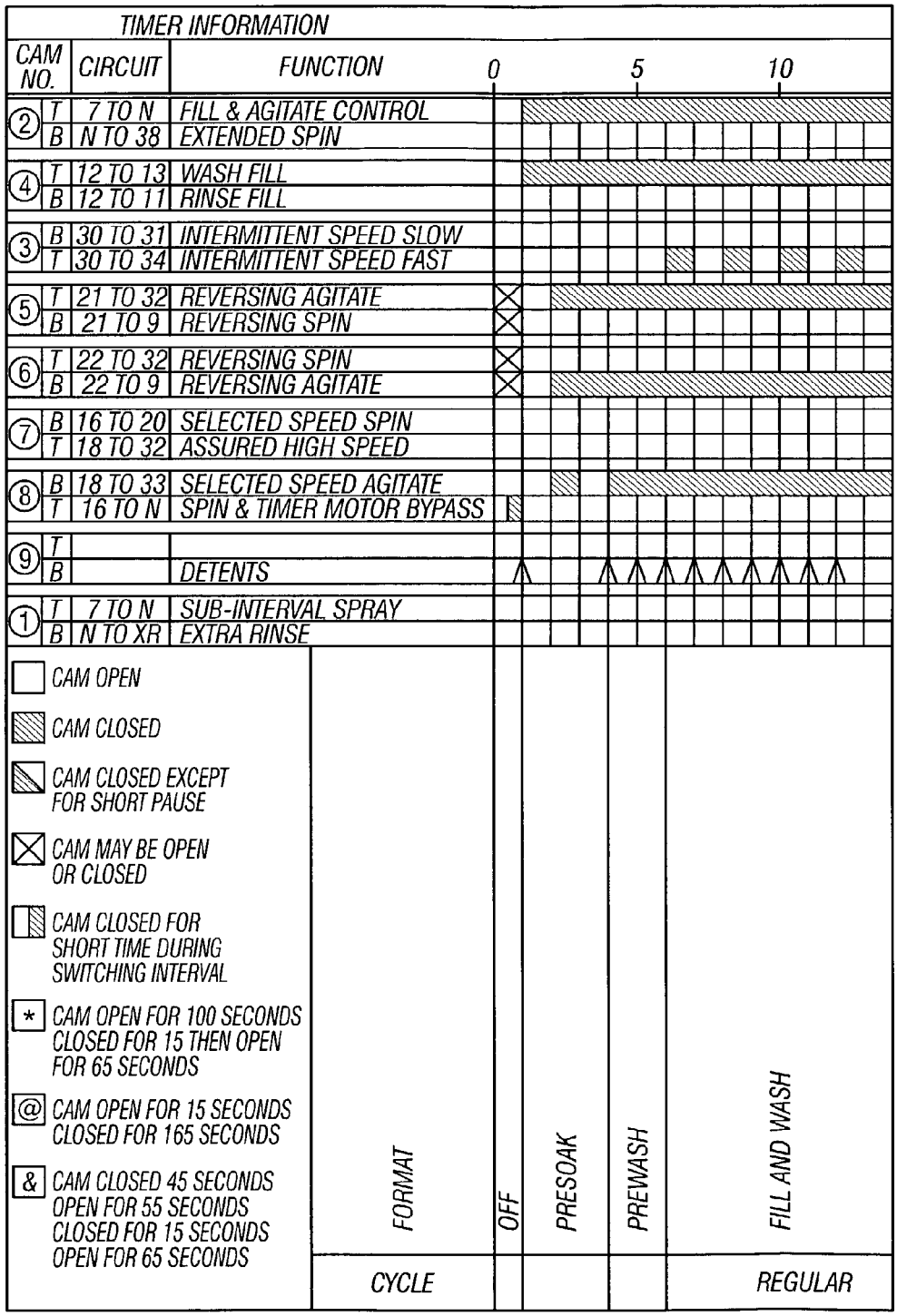
Figure 6B:
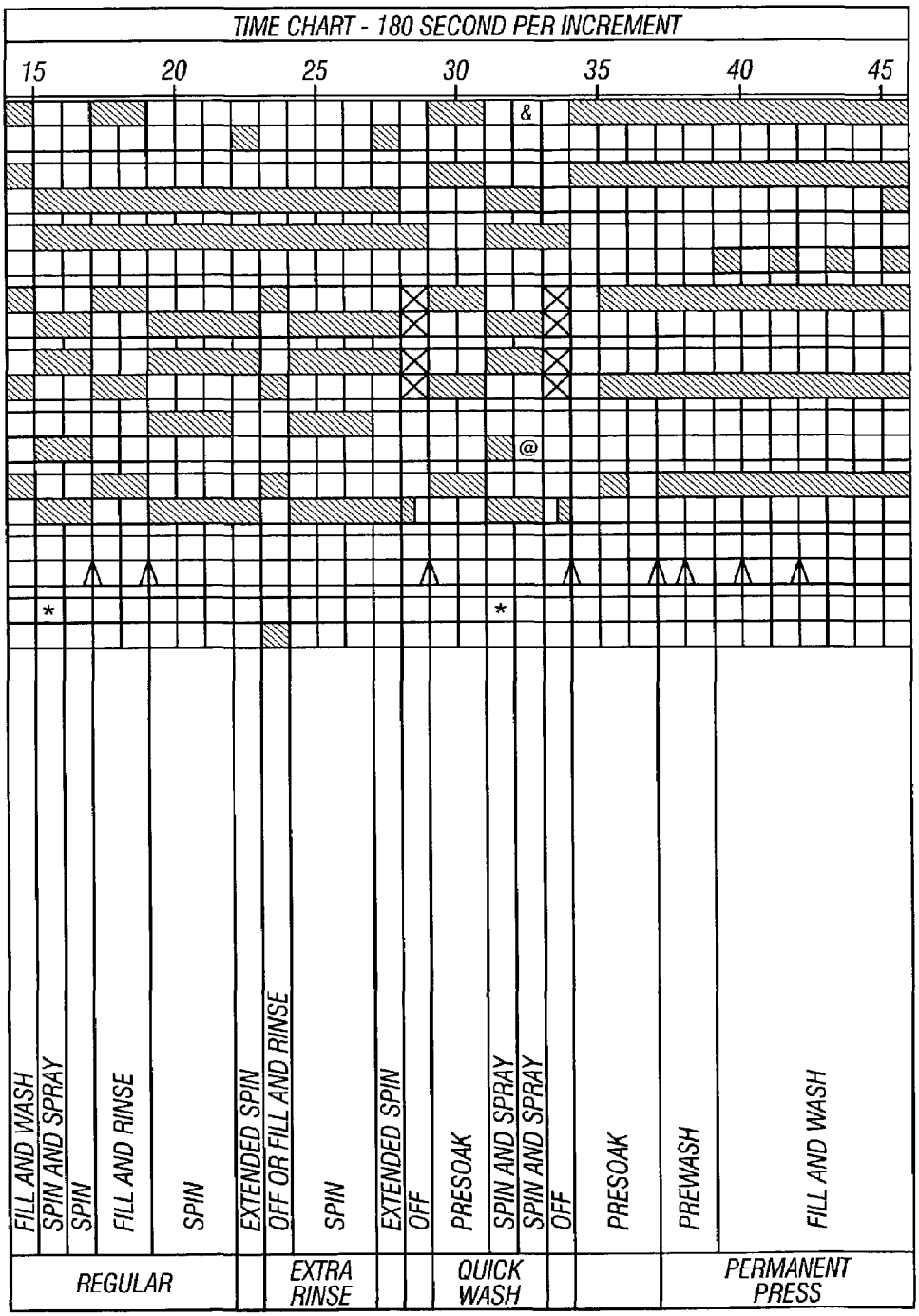
Figure 6C:
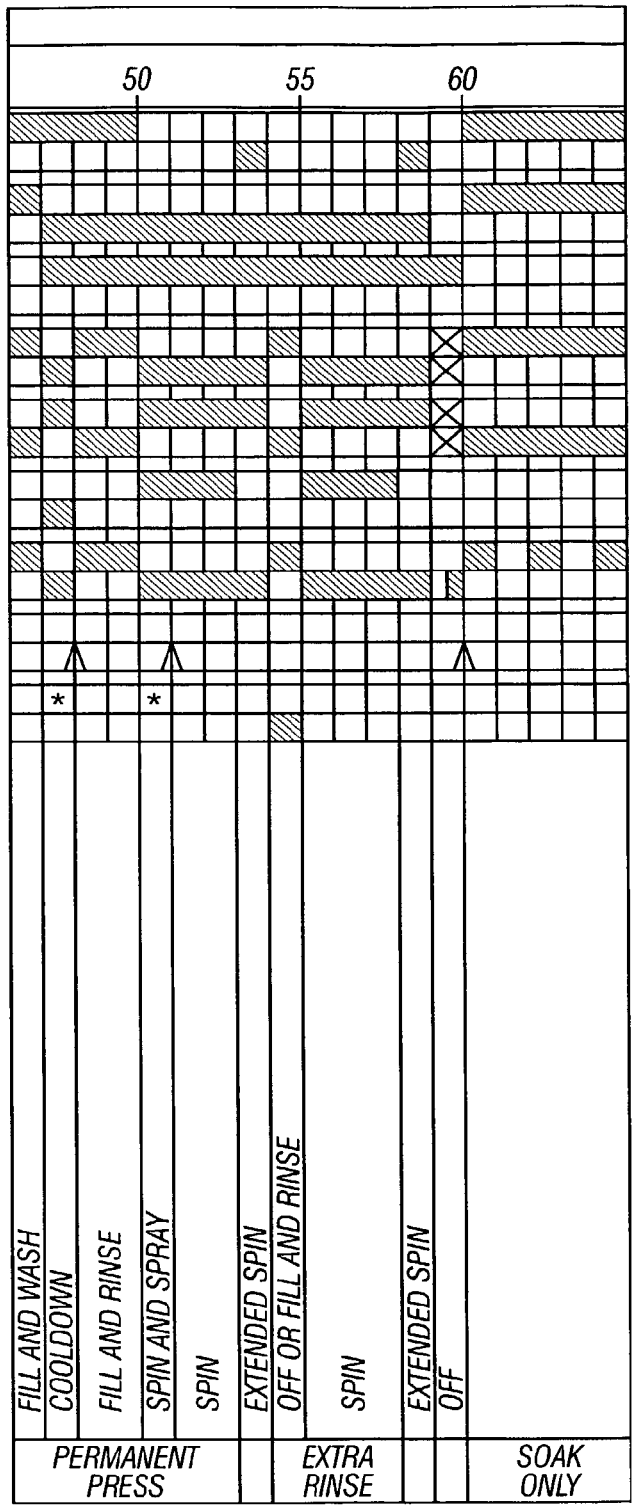

FIGS. 6A–C is a timing chart for the electrical circuit of FIG. 5.

IV. DETAILED DESCRIPTION OF THE INVENTION

A. Overview

To provide a better understanding of the present invention, one exemplary embodiment the invention can take is now described in detail. Frequent reference will be taken to the appended drawings. Reference numerals and letters will be used to indicate certain parts and locations in the drawings. The same reference numerals and/or letters will be used to indicate the same parts and locations throughout the drawings unless otherwise indicated. On the schematics of FIGS. 3 and 5, electrical nodes are represented with common reference numerals at each connection point. For example, the reference numeral of electrical node 32 can be found at the connections to the drive motor 54, the timer contact 5T, and the speed selector switch 116.

B. General Embodiment

Figure 1:
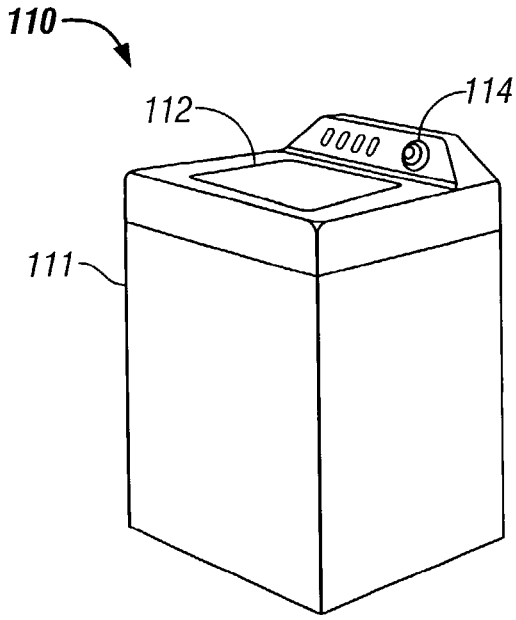
FIG. 1 is a perspective view of a washing machine including a control panel with the user-selectable agitation speed control.

The present invention relates to agitation speed or wash action control for an automatic washing machine. As shown in FIG. 1, washing machine 110 consists of a housing 111 (usually sheet metal) and includes a lid 112 and a control panel 114. Lid 112 provides access to the wash tub or drum (not shown) inside housing 111. Control apparatus and drive apparatus, such as a motor, are contained inside housing 111.

It is to be understood that the present invention pertains to automatic washing machines of most, if not all, types and configurations, including top loading and front loading machines.

In this embodiment, one drive motor is utilized to drive both spinning of the drum and the action of an agitator in the drum. The motor is a two-speed electric motor, to be referred to as high or regular speed and low or slow speed. The two speeds are accomplished here by passing electrical current through one of two different windings, such as is a well-known configuration.

Other aspects of washing machine 110 are well-known in the art, and therefore further detail will not be set for herein. Such detail can be found in a variety of patents and publications in the art.

Figure 2:
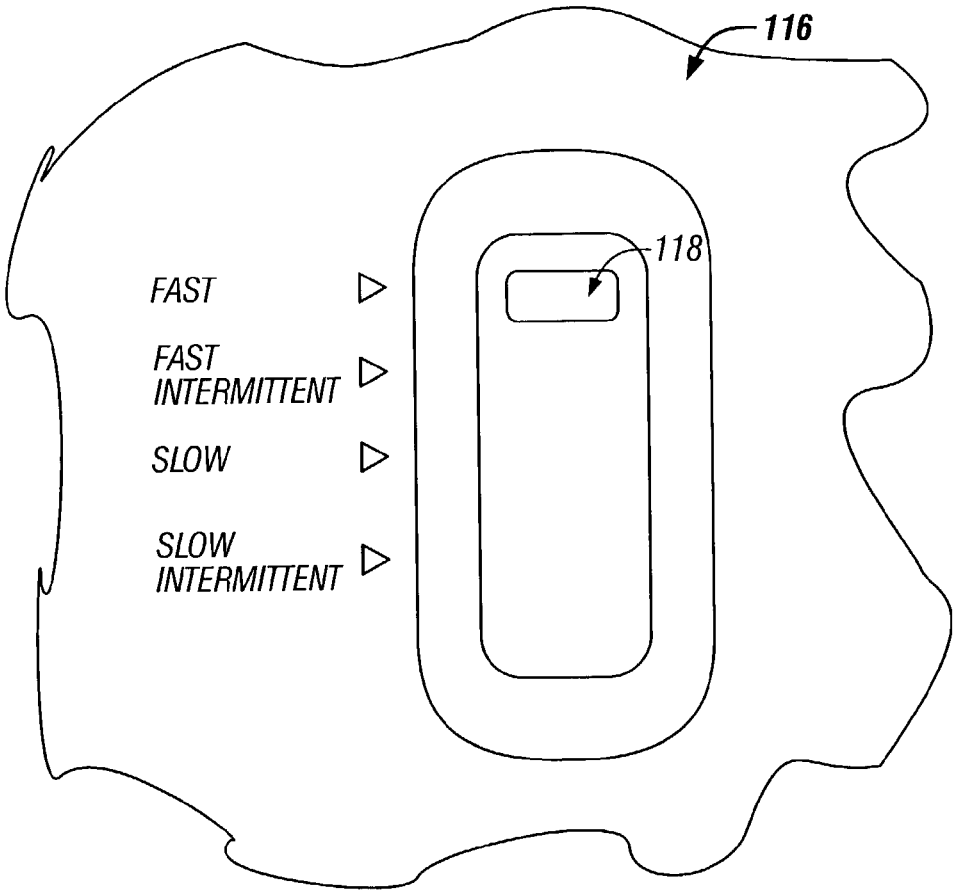
FIG. 2 is an enlarged diagrammatic view of the user selectable speed control.

The present invention focuses upon agitation speed control. In this embodiment, control panel 114 includes a dedicated speed switch 116 (see FIG. 2) comprising a slider 118 which the user can move to any of four discrete positions. Alternatively, rotary switches, push button switches or other selectors or user-interfaces (e.g. touch screen) for four discrete functions could be utilized.

The present invention is an alternative to the agitation speed control shown and described in U.S. Pat. No. 6,025,682. The U.S. Pat. No. 6,025,682 patent is incorporated by reference herein.

C. Apparatus of the Exemplary Embodiment

In addition to speed selector 116, which is manually operable by the user on the external control panel 114 of washing machine 110, the structure and configuration of an exemplary embodiment will be illustrated by reference to the electrical schematic of FIG. 3. Like U.S. Pat. No. 6,025,682, this circuit includes line voltage (L1) and neutral (N) and ground (Gnd), to provide household current and line voltage to washing machine 110. Two-speed electric drive motor 54, a lid switch 52, and an electric timer motor 56 are utilized in the circuit. Additionally, a water temperature switch 48, automatic temperature control switch 45, water level switch 47, and other functional features are included in the schematic of FIG. 3.

It is further to be understood that a number of cams, operatively associated with a spindle or axle rotationally driven by timer motor 56, control the opening and closing of contactors schematically depicted and numbered 1–9 in FIG. 3. These cams, well known in the art, are electromechanical and designed to control the operation of sub-circuits in the circuitry of FIG. 3, and thus, control a number of functions of the control circuit at large (and the washing machine). Those functions and duty cycles are set forth in the timing chart of FIG. 4.

The electromechanical cam arrangement is used in many present automatic washing machines. An electric motor rotates a spindle at a controlled rate. A user merely turns a control dial to a selected regime. This actuates the water valve to initiate filling of the wash tub with water. The spindle starts rotating when the selected water level is achieved. One or more cams rotate with the spindle. The cams cooperate with one or more electrical contactors positioned adjacent the spindle such that when the spindle is in a certain rotation position, one or more cams complete an electrical circuit by mechanically closing the points of a contactor (by shorting the points or by pushing a conductive member to a position which shorts the points). The configuration of the cam and the speed of rotation of the spindle determine the length of time the circuit is closed. As the cams go by corresponding contactors, the pre-programmed functions occur as the cams close and open circuits within the general control circuit of FIG. 3.

There can be more than one cam on the spindle, e.g. at various positions along the spindle's longitudinal axis or aligned on a surface lateral to the longitudinal axis of the spindle, such that a contactor can be closed and opened a plurality of times during one spindle rotation (and for the same or differing lengths of time), or a plurality of contactors can be closed or opened concurrently.

Present washing machine owners demand a range of "pre-programmed" washing regimens. As can be appreciated, there are usually practical limits on the amount of switching, the physical size of components, how many cams can be used or are available, etc. The U.S. Pat. No. 6,025,682 patent attempted to address this by replacing the electromechanical timer/cam arrangement at least partially with a microprocessor controlled timer, which can issue instructions to relays and other components to open and close circuits. However, as previously mentioned, while this arrangement frees up cams to be used for other functions, it adds significant cost to the washing machine. Although this solution provides a substantial number of options, such flexibility may exceed the value to most consumers.

Particularly, with regard to agitator speed selection, the circuit of FIG. 3 includes speed switch 116. Switch 116 has four discrete selections, each being user-selectable from control panel 114. Depending on which of the four choices F-, F, S, S- is selected by the user, when agitation is commanded by timing chart of FIG. 4 ("fill and wash" period), agitation speed proceeds according to that switch selection. In other words, the timing chart in FIG. 4 indicates when, during various washing regimes, the agitator will operate. Speed of agitation will proceed during those agitation periods according to the user's selection (via switch 116) and the timing chart between the following four options:

| SPEED SELECTION | DESCRIPTION |
|---|---|
| F | Continuous fast agitation speed-the high speed of the two-speed motor will be utilized to produce fast agitation on a continuous basis for as long as agitation is called for by the timing chart. |
| F– | Intermittent fast-periods of fast or high speed agitation using the high speed of the motor will alternate with periods of low speed agitation using low speed of the motor during the intermittent agitation time of the timing chart. |
| S | Assured slow-low speed of the two-speed motor will be utilized for lower speed agitation continuously during the time of agitation called for by the timing chart. |
| S– | Intermittent slow-agitation speed will alternate between sub-periods of slow agitation using the lower speed of the motor, and no agitation, for as long as the timing chart calls for such intermittent slow agitation. |

Thus, the apparatus to accomplish four different agitation regimes is accomplished by a two-speed motor, a four-position speed switch, and a timing chart for applicable timing cams that are used to operate contacts necessary to provide electrical power to cause motor 54 to operate in either low speed mode or high speed mode (or no speed mode) for an instructed time and/or duty cycle.

D. Operation

Again, by referring to FIGS. 3 and 4, the specific operation of the agitation speed control is described.

(1) Continuous Fast (F)

If the user wants a fast agitation at all agitation times, slider 118 on speed selector 116 is set to "fast" or "F" in FIG. 3. When power is supplied to the drive motor 54 during an agitation period the time chart of FIG. 4 (timer contact 8B is conducting), the path of current through drive motor will be:

(a) from L1 through the lid switch 52 to node M (see FIG. 3)

(b) through "REG" winding (the fast speed winding) to node 32;

(c) through the switch between nodes 32 and 33 at the "F" contact on switch 116;

(d) through timer contact 8B to node 16;

(e) through the water level switch to node 7;

(f) then through timer contact 2T to node N.

Thus, during preprogrammed selected speed agitation periods that are controlled by timer contact 8B (see timing diagram of FIG. 4), if switch 116 is set to "F" position, the current path is through the regular (or "fast") winding of motor 54 at all times; which causes the agitation impeller to rotate at continuous "fast" speed during those periods of time. In this fashion, as long as other required conditions and timed operations are in place, continuous fast agitation speed occurs during any instructed agitation periods by timing chart of FIG. 4. It is noted that current pathway through switch position F is the only pathway to "N", and neither of timer contacts 3B or 3T are conducting.

(2) Continuous Slow (S)

Similarly, if switch 116 selection "S" is selected for continuous "slow" agitation speed, if other things are in place, electrical current would flow:

(a) from L1 through the lid switch 52 to node M;

(b) through the SLOW or "low speed" coil between nodes M and 31 in drive motor 54;

(c) through speed switch 116 at contact "S" to node 33;

(d) through timer contact 8B to node 16;

(e) through the water level switch to node 7;

(f) then through timer contact 2T to node N.

This is the only path through speed switch 116 between L1 and N for drive motor 54 and therefore provides continuous slow agitation speed for any period in which agitation is instructed by the timing chart of FIG. 4.

Therefore, using standard electromechanical cams and contacts in conjunction with a conventional electric timing motor 56, the user is given the option of two user-selectable continuous speeds (continuous fast or continuous slow) by simply moving the hand-operated slide control 118 to the appropriate "F" or "S" position. No microprocessors or relays are used.

(3) Intermittent Fast (F-)

But further, and in contrast to the two continuous speeds, if intermittent fast (F-) is selected at speed switch 116, during agitation times in the timing diagram of FIG. 4, motor 54 would run for alternating sub-periods of fast speed and slow speed. This is accomplished as follows.

As indicated along the time chart of FIG. 4, timer contact 3 would toggle between making its bottom half (B) conductive (between nodes 31 and 30) and its top half (T) conductive (between nodes 34 and 30). As timer motor 56 turns cams 1–9, timing cams would alternatively close the bottom half for one 180 second increment, then open the bottom half and concurrently close the top half for a 180 second increment, and repeat three more times during agitation in the regular wash regime of FIG. 4. This would result in successive sub-periods of 180 seconds each of alternating slow then fast agitation. Thus, the washing action would differ in the sense that agitation speed would change, and over the course of the whole agitation period, the average speed or cumulative energy imparted to agitation is less than continuous fast, but greater than continuous slow.

As is apparent from FIGS. 3 and 4, intermittent fast is accomplished when the speed switch 116 is in position "F-". The path from L1 to the motor windings is identical to that described above in the continuous fast and continuous slow selections. The path from the Neutral node (N) to the motor windings is as follows:

(a) from node N through timer contact 2T to node 7;

(b) through the water level switch 47 to node 16;

(c) through timer contact 8B to node 33;

(d) then through speed switch 116 at contact "S-, F-" to node 30.

(e) At this point, the path varies according to the time chart of FIG. 4 for timer contacts 3T and 3B.

1. When timer contact 3T is closed the path is from node 34, through speed switch 116 to node 32 at the "F, F-" contact, and to the fast speed winding of drive motor 54.
2. When timer contact 3B is closed, the path is to node 31 to the slow speed winding of drive motor 54.

When machine 110 is in permanent press cycle, agitation would similarly alternate between an increment of slow speed and an increment of fast speed, but for three, as opposed to four, sets of slow/fast (see FIG. 4). Thus, the cams can be built to have different slow/fast repetitions for different wash cycles. FIG. 4 is but one way to program the cams. There could be more or less slow/fast repetitions. The length of each slow or fast sub-period could be more or less than one timing chart increment (180 seconds). For example, F- could begin with two 180 second increments of slow speed, followed by two 180 second increments of fast speed. The length of a slow or fast sub-period could differ from a succeeding or preceding agitation sub-period. For example, F- could begin with two 180 second increments of slow speed, followed by one 180 second increment of fast speed. Or fractions of increments could be used.

(4) Intermittent Slow (S-)

Similarly, if "S-" or intermittent slow is selected at speed switch 116, motor 54 would alternate between slow agitation speed and no agitation according to the timing chart of FIG. 4. Again, the path from L1 to the motor windings is identical to that described above in the continuous fast and continuous slow selections. The path from the Neutral node (N) to the motor windings is as follows:

a) from node N through timer contact 2T to node 7;

b) through the water level switch 47 to node 16;

c) through timer contact 8B to node 33;

d) then through speed switch 116 at contact "S-, F-" to node 30.

e) At this point, the path varies according to the time chart of FIG. 4 for timer contacts 3T and 3B.

1. When timer contact 3T is closed, there is no path to the motor as there is no connection point through speed switch 116. This represents a period of no agitation.
2. When timer contact 3B is closed, the path is to node 31, to the slow speed winding of drive motor 54.

Therefore, intermittent periods of slow agitation followed by no agitation will be instructed by timing chart of FIG. 4. During the whole agitation period, therefore, the average speed will be less than continuous slow and the energy imparted by agitation will be alternated between some and none. Again, this intermittent slow function is accomplished without a microprocessor or relays.

As can be seen, the above-described four option arrangement allows four different agitation functions which are user-selectable. The duty cycles for each are controlled by the timing chart of FIG. 4.

E. Alternatives and Options

The exemplary embodiment is given by example only. Variations obvious to those skilled in the art will be included within the invention. For example, variations on the circuit of FIG. 3 in the timing chart of FIG. 4 are possible.

It is well known in the art to provide numerous variations of user selections throughout a model line. As such is the case, the agitation speeds discussed above may be employed in various combinations. For instance, various machines could employ combinations of continuous fast, continuous slow, and either (or both of) intermittent fast and intermittent slow selections.

Another example of an apparatus providing the aforementioned speed selections is shown in FIGS. 5 and 6. Instead of utilizing timer contacts and cams for controlling intermittent agitation speeds, a double-pole, double-throw relay (see reference number 117 of FIG. 5) can be substituted. Relay 117 can be activated via timer contact 3T according to the timing chart of FIG. 6. This embodiment works the same as the embodiment of FIGS. 3 and 4, providing continuous fast when speed switch 116 is closed at position "F", continuous slow when speed switch 116 is closed at position "S", intermittent fast when speed switch 116 is closed at position "F-", and intermittent slow when speed switch 116 is closed at position "S-"; providing four discrete agitation functions.

When "F" or "S" are selected, there is a direct current path from either "REG" at node 32 or "SLOW" coil at node 31 of motor 54 to node 33 through the speed switch 116. Therefore, like the embodiment of FIGS. 3 and 4, there are two continuous speeds selectable by the user, using the two speeds of the motor.

When "F-" or "S-" (intermittent fast or intermittent slow) is selected during agitation, timer contact 3T would instruct relay 117 to alternate between two states. A first state, shown in FIG. 5, shorts nodes 32 to 30 and 31 to 34. A second state, when sufficient current flows through inductor (between nodes N and 17 of relay 117), shorts nodes 31 to 30 and 6 to 34.

As can be appreciated by viewing FIGS. 5 and 6 in combination, when the user sets switch 116 to "F-", node 30 is shorted to node 33. The only current path through motor 54 is through the left side of relay 117 in FIG. 5 (between either node 30 to 31 or 30 to 32). Timer contact 3T would present a current path through the "SLOW" coil of motor 54 (node M to 31) during timing increments 7, 9, 11 & 13 (see FIG. 6), because during these increments, timer contact 3T would be closed and would cause sufficient current to energize the coil of relay 117 to short nodes 31 and 30. But during increments 8, 10, 12 & 14, timer contact 3T opens, which causes current to flow through the "REG" (or fast) coil of motor 54, because the current path for motor 54 is through nodes 32 to 30 (which are shorted because the relay coil is not energized). Thus, in "F-" mode, timer contact 3T controls the switching of relay 117 which alternates between fast and slow motor speeds, like the embodiment of FIGS. 3 and 4. A similar effect occurs during timing increments 40 to 46.

If "S-" is selected, the only current path for motor 54 to N is through nodes 34 and 33 at speed switch 116 and nodes 34 to 31 at relay 117. As indicated at FIGS. 5 and 6, timer contact 3T would toggle between energizing and not energizing the coil of relay 117, which alternatingly shorts nodes 31 to 34 of relay 117 (when relay 117 is not energized), which would operate motor 54 at "slow" speed, and short nodes 6 and 34 of relay 117, which would not operate motor 54 at either speed because it breaks any current path through motor 54 (point 6 is not conducting to N).

The arrangement of FIGS. 5 and 6 is a little more costly than that of FIGS. 3 and 4 because of the utilization of the relay 117, but can be advantageous if additional timer contacts are not available, or can be better utilized for other functions.

As can be appreciated, even a one-speed motor could utilize the concepts of the invention. Two "speeds" for a one-speed motor can be enabled by selecting between a continuous speed and an intermittent speed (alternating sub-periods of at-speed and no-speed during an agitation period). Or the intermittent speed alone could be used and duty cycle of running at-speed, compared to sub-periods of no speed, programmed for certain agitation periods and agitation selections, to provide a plurality of washing action functions to the user independent of washing cycle.

On the other hand, these principles could be applied to systems having drive motors of more than two speeds. Continuous speed options up to the number of speeds of the drive motor could be offered the user, along with intermittent speed options that would alternate between any two speeds, or between a speed and no speed. Or, again, duty cycle of any motor speed could be adjusted for different agitation action, as the basis for user control of washing action independent of washing cycle.

What is claimed is:

1. A wash action control system for a washing machine having a wash tub, an agitator disposed within said wash tub, and a motor for operating said agitator comprising:

an electrical control circuit connected to said motor;

a speed selection control associated with said control circuit, the speed selection control comprising a plurality of discrete speed selections, at least one of said selections comprising an intermittent speed selection enabling said control circuit to cause said motor to operate said agitator at varying, intermittent speeds;

an electromechanical timer driven by an electrical timer motor and associated with said control circuit, the electromechanical timer comprising first and second electromechanical timer circuits;

the first electromechanical timer circuit adapted to provide power to said speed selection control at predetermined times; and said speed selection control adapted to provide power usable by a second electromechanical timer circuit wherein said second electromechanical timer circuit controls switching of the speed of said motor at predetermined time intervals to provide said intermittent speeds.

2. A wash action control system according to claim 1 wherein said discrete speed selections include an intermittent slow selection wherein said control circuit causes said motor to alternate between operating the agitator slowly and not at all, an assured slow selection wherein said control circuit causes said motor to operate said agitator slowly and continuously, and an assured fast selection wherein said control circuit causes said motor to operate said agitator continuously fast.

3. A wash action control system according to claim 2 wherein said discrete speed selections further include an intermittent fast selection wherein said control circuit causes said motor to alternate between operating said agitator slow and fast.

4. A wash action control system according to claim 1 wherein said discrete speed selections include an assured slow selection wherein said control circuit causes said motor to operate said agitator slowly and continuously, an intermittent fast selection wherein said control circuit causes said motor to alternate between operating said agitator slow and fast, and an assured fast selection wherein said control circuit causes said motor to operate said agitator continuously fast.

5. The wash action control system of claim 1 wherein the speed selection control comprises a switch.

6. The wash action control system of claim 1 wherein the speed selection control comprises a manually operable user interface.

7. The wash action control system of claim 1 wherein the motor is an electric motor having at least one speed.

8. The wash action control system of claim 7 wherein a first speed selection is continuous agitation and a second speed selection is intermittent agitation.

9. The wash action control system of claim 8 wherein the intermittent agitation changes between agitation at a first speed and agitation at a second speed.

10. The wash action control system of claim 9 wherein the second speed is a speed slower than the first speed.

11. The wash action control system of claim 10 wherein the speed slower than the first speed is no speed or no agitation.

12. The wash action control system of claim 9 wherein the second speed is a faster speed than the first speed.

13. The wash action control system of claim 1 wherein the motor has two or more speeds and the plurality of agitation speeds comprise continuous agitation at each of the motor speeds along with intermittent alternating periods of agitation between any two motor speeds or intermittent alternating periods of agitation between a motor speed and no motor speed.

14. The control system of claim 1 wherein the second electromechanical timer circuit comprises a relay and electrical contacts.

15. The control system of claim 1 wherein the electromechanical timer comprises a plurality of cam-driven switches.

16. The control system of claim 15 wherein the cam-driven switch comprises a timing cam which is rotated by the electrical timer motor and electrical contacts which are adapted to close an electrical circuit in response to position of the timing cam.

17. A wash action control system for a washing machine having a wash tub, an agitator disposed within said wash tub, and a motor for operating said agitator comprising:

an electrical control circuit connected to said motor;

a speed selection control associated with said control circuit for providing a plurality of discrete speed selections, at least one of said selections enabling said control circuit to cause said motor to operate said agitator at varying, intermittent speeds;

a relay associated with said control circuit and operable for providing at least one circuit to control said intermittent speeds;

an electromechanical timer driven by an electrical timer motor and associated with said control circuit and having a first electromechanical timer circuit for providing power to said speed selection control at predetermined times and further including a second electromechanical timer circuit to provide power to said relay at predetermined times; and said speed selection control selectively providing power to said at least one circuit related to said relay wherein said second electromechanical timer circuit causes said relay to switch the speed of said motor at predetermined times to provide said intermittent speeds.

18. A wash action control system according to claim 17 wherein said discrete speed selections include an intermittent slow selection wherein said control circuit causes said motor to alternate between operating the agitator slowly and not at all, an assured slow selection wherein said control circuit causes said motor to operate said agitator slowly and continuously, and an assured fast selection wherein said control circuit causes said motor to operate said agitator continuously fast.

19. A wash action control system according to claim 18 wherein said discrete speed selections further includes an intermittent fast selection wherein said control circuit causes said motor to alternate between operating said agitator slow and fast.

20. A wash action control system according to claim 17 wherein said discrete speed selections include an assured slow selection wherein said control circuit causes said motor to operate said agitator slowly and continuously, an intermittent fast selection wherein said control circuit causes said motor to alternate between operating said agitator slow and fast, and an assured fast selection wherein said control circuit causes said motor to operate said agitator continuously fast.

21. The wash action control system of claim 17 wherein the speed selection control comprises a switch.

22. The wash action control system of claim 17 wherein the speed selection control comprises a manually operable user interface.

23. The control system of claim 17 wherein the electromechanical timer comprises a plurality of cam-driven switches.

24. The control system of claim 16 wherein the cam-driven switch comprises a timing cam which is rotated by the electrical timer motor and electrical contacts which are adapted to close an electrical circuit in response to position of the timing cam.

* * * * *